US010682027B2

(12) United States Patent
Ji

(10) Patent No.: US 10,682,027 B2
(45) Date of Patent: Jun. 16, 2020

(54) HEATED TOILET SEAT

(71) Applicant: Shanghai Kohler Electronics, Ltd., Shanghai (CN)

(72) Inventor: Yong Ji, Shanghai (CN)

(73) Assignee: SHANGHAI KOHLER ELECTRONICS, LTD., Shanghai (CN)

( * ) Notice: Subject to any disclaimer, the term of this patent is extended or adjusted under 35 U.S.C. 154(b) by 0 days.

(21) Appl. No.: 15/827,913

(22) Filed: Nov. 30, 2017

(65) Prior Publication Data

US 2018/0153363 A1 Jun. 7, 2018

(30) Foreign Application Priority Data

Dec. 1, 2016 (CN) ..... 2016 1 1093553

(51) Int. Cl.
*A47K 13/30* (2006.01)

(52) U.S. Cl.
CPC ..... *A47K 13/305* (2013.01)

(58) Field of Classification Search
CPC ..... A47K 13/305
USPC ..... 4/237
See application file for complete search history.

(56) References Cited

U.S. PATENT DOCUMENTS 1,839,156 A * 12/1931 Lumpkin ..... A47K 13/305 4/233
5,898,952 A * 5/1999 Hickey ..... A47K 13/305 4/237
2008/0109951 A1* 5/2008 Datsko ..... A47K 13/24 4/237
2009/0064402 A1* 3/2009 Mauduit ..... A47K 13/12 4/236
2014/0091262 A1* 4/2014 Webber ..... C23F 11/145 252/391

* cited by examiner

*Primary Examiner* — Lauren A Crane
(74) *Attorney, Agent, or Firm* — Foley & Lardner LLP

(57) ABSTRACT

A heated seat having a thermally conductive metal seat, a protective coating disposed on a top surface of the metal seat, and a thermally conductive water pipe in the thermally conductive metal seat. Hot water can be routed through the water pipe to heat the seat. This arrangement improves safety and enables the heat from the hot water to be rapidly conducted through the seat, thereby improving the comfort in use.

10 Claims, 6 Drawing Sheets

A-A

B-B

HEATED TOILET SEAT

CROSS-REFERENCE TO RELATED APPLICATIONS

The present application claims the benefit and priority to Chinese Patent Application No. 201611093553.1, filed on Dec. 1, 2016, which is incorporated herein by reference in its entirety.

BACKGROUND

The present application relates generally to the technical field of toilet seats, and more particularly to heated toilet seats.

A seat is a part of a toilet. Along with the improved standard of living, seats are heated during cold days to become more comfortable.

SUMMARY

The present application overcomes the drawbacks of traditional toilet seats by providing a heated seat that can be rapidly heated and is very safe.

At least one embodiment of the present application includes a heated seat having a thermally conductive metal seat and a protective coating disposed on the top surface of the metal seat, and the metal seat further includes a thermally conductive water pipe.

Furthermore, the thermally conductive water pipe includes a water inlet, a water outlet, and a thermally conductive water pipe body connected between the water inlet and the water outlet. Furthermore, the thermally conductive water pipe body can be formed (e.g., cast) inside the metal seat.

Furthermore, a slot can be formed on the bottom surface of the metal seat and the thermally conductive water pipe body is received inside the slot through an interference fit.

Furthermore, the overall shape of the slot can match the overall shape of the thermally conductive water pipe body, and the whole thermally conductive water pipe body is received inside the slot through the interference fit.

Furthermore, the slot can be directly cut out from the bottom surface of the metal seat.

Furthermore, the slot includes two ribs that can be arranged opposing one another, wherein the ribs are integrally molded on the bottom surface of the metal seat.

Furthermore, the metal seat includes a seat installation end connected to the toilet body, and a seat body for a user to sit on. The seat body contains the thermally conductive water pipe body.

Furthermore, the water inlet and the water outlet can be arranged next to each other.

Furthermore, the thermally conductive water pipe can be copper pipe.

The heated toilet seats, as disclosed in this application, provide numerous advantages, several of which are described herein.

For example, by providing thermally conductive water pipes inside the metal seat or on the bottom surface thereof, hot water can be used for heating. The thermally conductive water pipes advantageously quickly transfer heat to the metal seat, and at the same time, ensure a uniform surface temperature of the seat. Moreover, hot water, instead of a resistance wire, is used for heating, which improves the safety by reducing or eliminating the risk of electric shock.

Those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Specific embodiments of the present application will be further described below with reference to the accompanying drawings, wherein the same parts are represented with the same legends. It should be noted that the terms, "front", "rear", "left", "right", "up", and "down", used in the description below refer to the directions in the accompanying drawings, and the terms, "inner" and "outer", refer to directions toward or away from the geometric center of a particular part, respectively.

Figure 1:
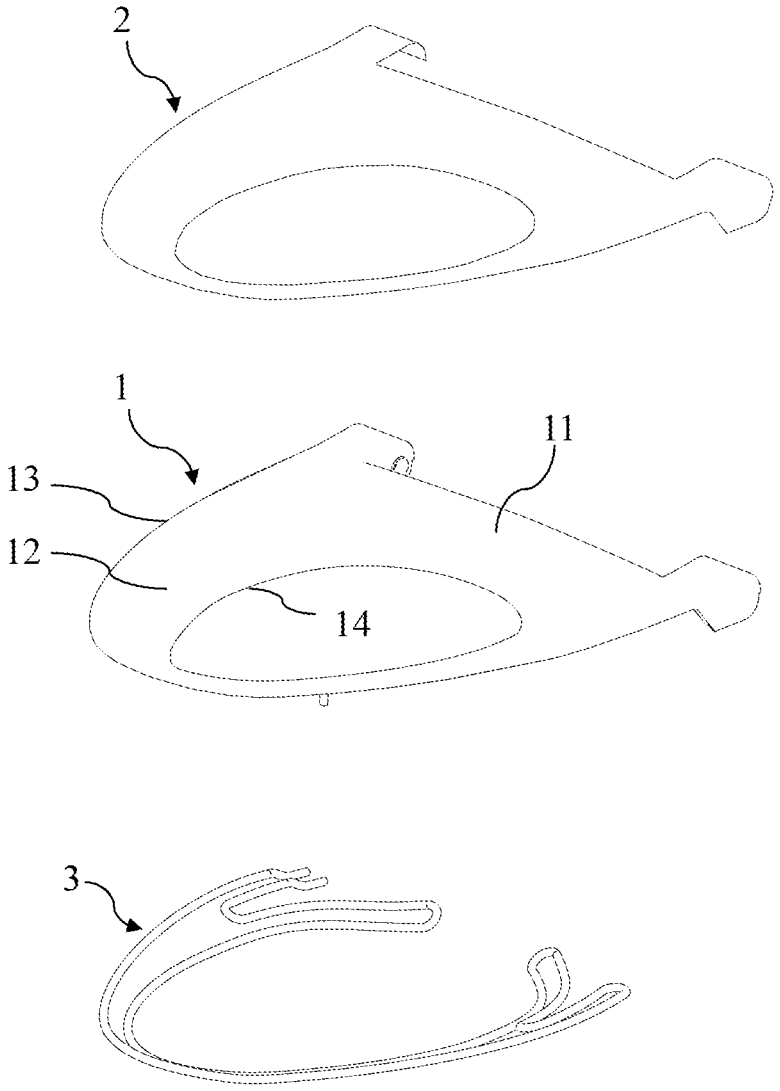
FIG. 1 is an exploded perspective view of a heated seat, according to an embodiment of the present application.

FIG. 1 illustrates a heated seat according to an exemplary embodiment of the present application, and the heated seat includes a thermally conductive metal seat 1 and a protective coating 2 disposed on the top surface of the metal seat 1. The metal seat 1 contains a thermally conductive water pipe 3.

The top surface of the metal seat 1 refers to the surface of the metal seat 1 facing toward the ceiling after installation, and the bottom surface of the metal seat 1 refers to the surface of the metal seat 1 facing toward the floor after installation.

Advantageously, because the metal seat 1 includes the thermally conductive water pipe 3, the seat can be heated by hot water flowing through the water pipe 3. The thermally conductive water pipe 3 quickly transfers heat to the metal seat 1, which quickly increases the surface temperature of the metal seat 1. The temperature of the protective coating 2 increases accordingly, such that a desired temperature can be reached within a relatively short time (e.g., before use by a user), thereby improving the comfort for the user.

According to the present application, hot water, instead of a resistance wire, is used for heating, which improves the safety. The heated seat according to the present application may also be referred to as a water heated seat.

The protective coating 2, according to an exemplary embodiment, is a relatively thin coating (e.g., compared to the metal seat) sprayed onto the top surface of the metal seat 1, such as spray plastic or spray paint, which is used to protect the metal seat 1 from corrosion.

The metal seat 1 includes a metal material having a high heat transfer coefficient, such as an aluminum alloy. Due to the high heat conductivity of the material, heat is quickly conducted from the hot water to the metal seat, which ensures a relatively uniform surface temperature of the metal seat.

The thermally conductive water pipe 3, according to an exemplary embodiment, includes a metal material having a high heat transfer coefficient, such as copper. For example, the water pipe 3 can be a copper pipe, which can transfer heat quickly and improve the heating effect.

Figure 2:
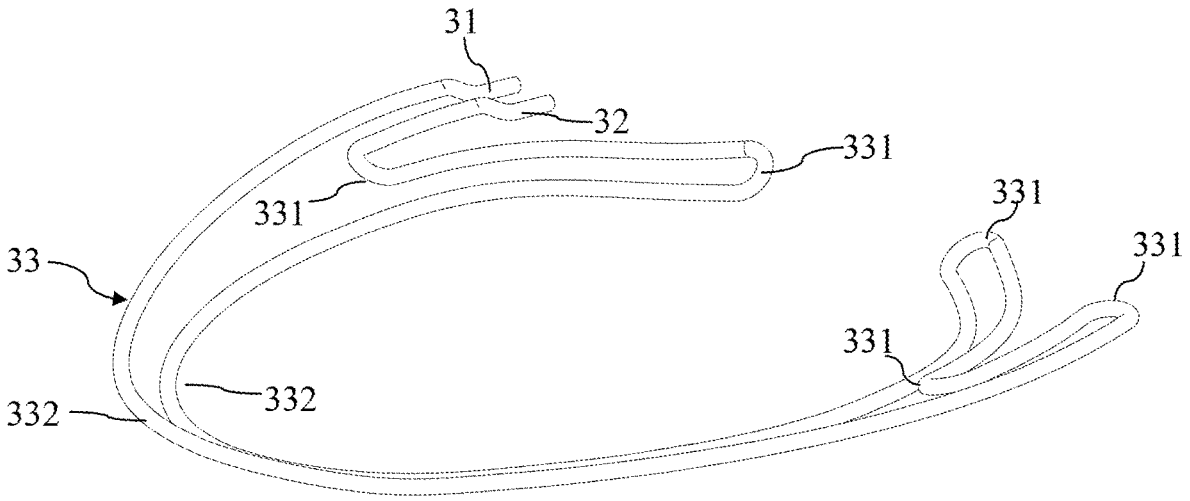
FIG. 2 is a perspective view of a thermally conductive water pipe of the heated seat shown in FIG. 1, according to an exemplary embodiment.

Referring now to FIG. 2, the thermally conductive water pipe 3 includes a water inlet 31, a water outlet 32, and a thermally conductive water pipe body 33 connected between the water inlet 31 and the water outlet 32. As shown, the thermally conductive water pipe body 33 includes a plurality of bending parts 331 and an extension 332 therebetween. The extension 332 generally follows the contour of the metal seat 1.

As shown in FIGS. 1-2, the metal seat 1 includes a seat installation end 11, which is connectable to the toilet body, and a seat body 12 for a user to sit on. The seat body 12 houses the thermally conductive water pipe body 33. In this way, hot water inside the thermally conductive water pipe body 33 can rapidly heat the seat body 12, which improves the heating effect. The metal seat 1 further includes an outer edge 13 and an inner edge 14, wherein the inner edge 14 defines an opening within the seat 1.

As shown in FIG. 2, in one embodiment, the water inlet 31 can be interconnected to a first bend 331 by an outer path of the extension 332. The outer path of the extension 332 can follow the same overall contour as the outer edge 13 of the seat 1. The first bend 331 may change the direction of the flow of water (e.g., switchback) and connect with a second bend 331. The second bend 331 can be disposed closer to the seat body 12 than the first bend 331. The second bend 331 may similarly change the direction of the flow of water and connect with a third bend 331 that is disposed further away from the seat body 12 than the second bend 331. The third bend 331 may be interconnected to a fourth bend 331 by way of an inner path of the extension 332. The inner path of the extension can follow the same overall contour as the inner edge 14 of the seat 1. The fourth bend 331 may change the direction of the flow of water (e.g., switchback) and connect with a fifth bend 331. The fourth bend 331 can be disposed further from the seat body 12 than the fifth bend 331. The fifth bend 331 connect to the water outlet 32, which is disposed adjacent to the water inlet 31.

In addition, though the seat body 12 generally houses the thermally conductive water pipe body 33, the plurality of bending parts 331 may, for example, extend towards the seat installation end 11, and follow the general contour of the seat 1. The extension 332 can be formed such that it is adjacent to and follows the general contour of the outer edge 13, while also being adjacent to and following the general contour of the inner edge 14. In other words, as shown in FIG. 2, the extension 332 can have an outer path and an inner path which are connected by the plurality of bending parts 331.

Though the plurality of bending parts 331 are shown as having one bending part flowing away from the seat installation end 11 on opposite sides of the seat body 12, it is envisioned that the plurality of bending parts 331 may be formed to have any number of bends. As a result, the hot water flowing within the thermally conductive water pipe 3 may reach a larger surface area of the seat body 12, the water-holding capacity may be increased, and consequently, the capability of heating the metal seat 1 may be improved.

Figure 3:
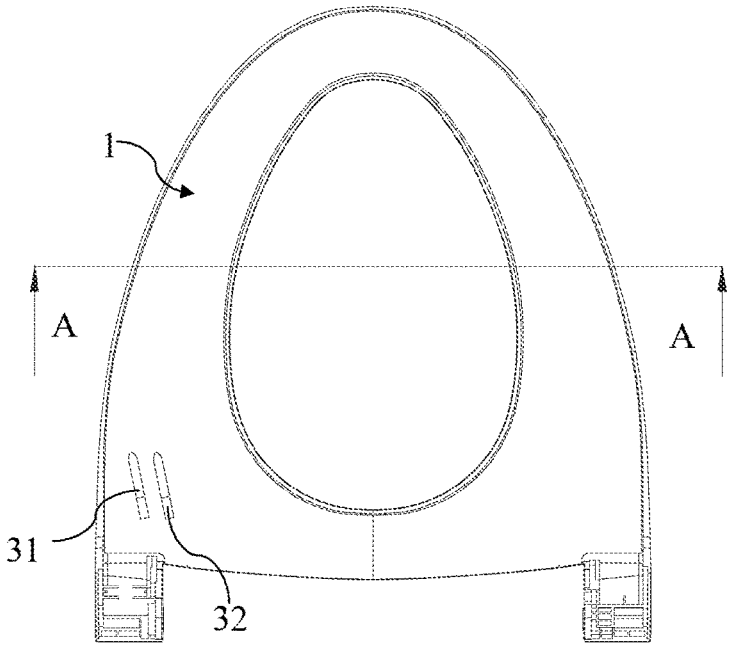
FIG. 3 is a bottom view showing that the thermally conductive water pipe body is formed inside the thermally conductive metal seat of the heated seat of FIG. 1, according to an exemplary embodiment.
Figure 4:
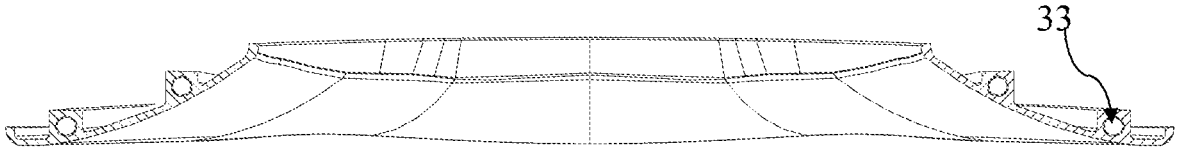
FIG. 4 is a cross-sectional view of the seat taken along line A-A in FIG. 3.
Figure 5:
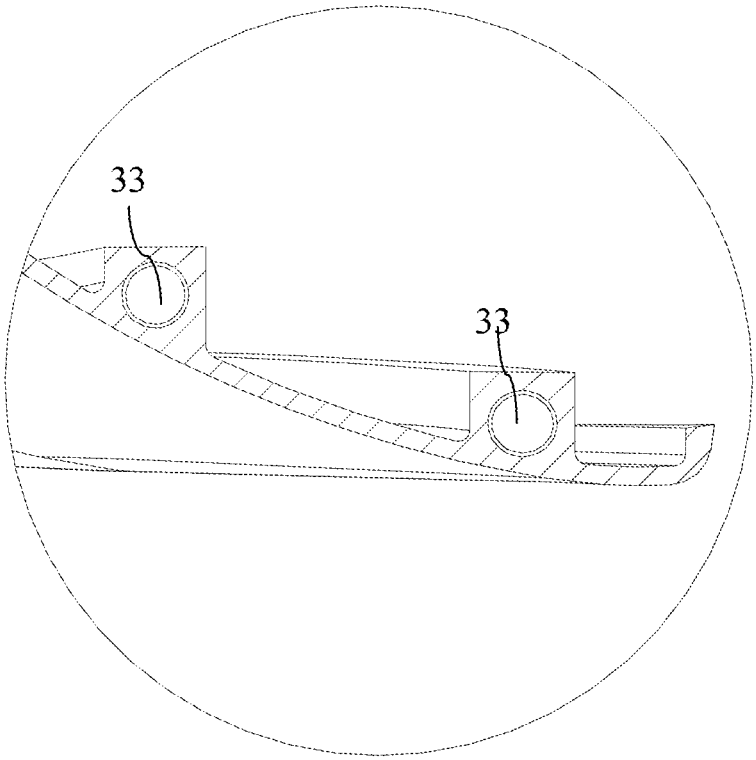
FIG. 5 is an enlarged detail view of a portion of the seat shown in FIG. 4.

Referring now to FIGS. 3-5, the thermally conductive water pipe body 33 can be formed (e.g., cast, molded, etc.) inside the metal seat 1 with only the water inlet 31 and the water outlet 32 exposed outside of the metal seat 1 for connection with an external water pipe. For example, the thermally conductive water pipe body 33 can be embedded in a mold for making the metal seat 1, and when the metal seat 1 is formed, the thermally conductive water pipe body 33 is directly cast inside the metal seat 1. By casting the thermally conductive water pipe body 33 inside the metal seat 1, the entire surface of the thermally conductive water pipe body 33 can transfer heat to the metal seat 1, which improves the heat transfer capability of heating the metal seat 1. In addition, by casting the thermally conductive water pipe body 33 inside the metal seat 1, the contour and surface of the metal seat 1 will not be destroyed, leading to a uniform appearance of the metal seat 1, and the thermally conductive water pipe body 33 can be firmly installed inside the metal seat 1. In effect, by integrally forming the water pipe body 33 within the metal seat 1, the water pipe body 33 is effectively self-sealed within the metal seat 1.

Figure 6:
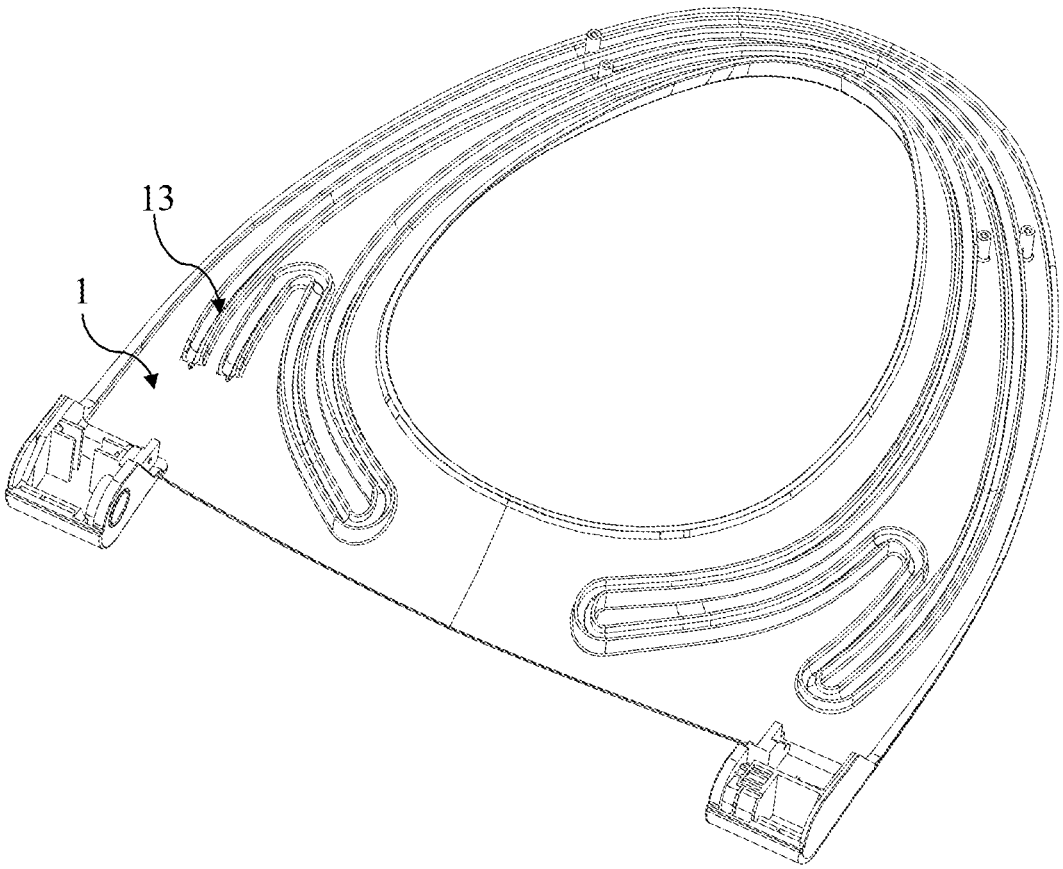
FIG. 6 is a perspective view showing a slot formed in a bottom surface of the heated seat of FIG. 1.
Figure 7:
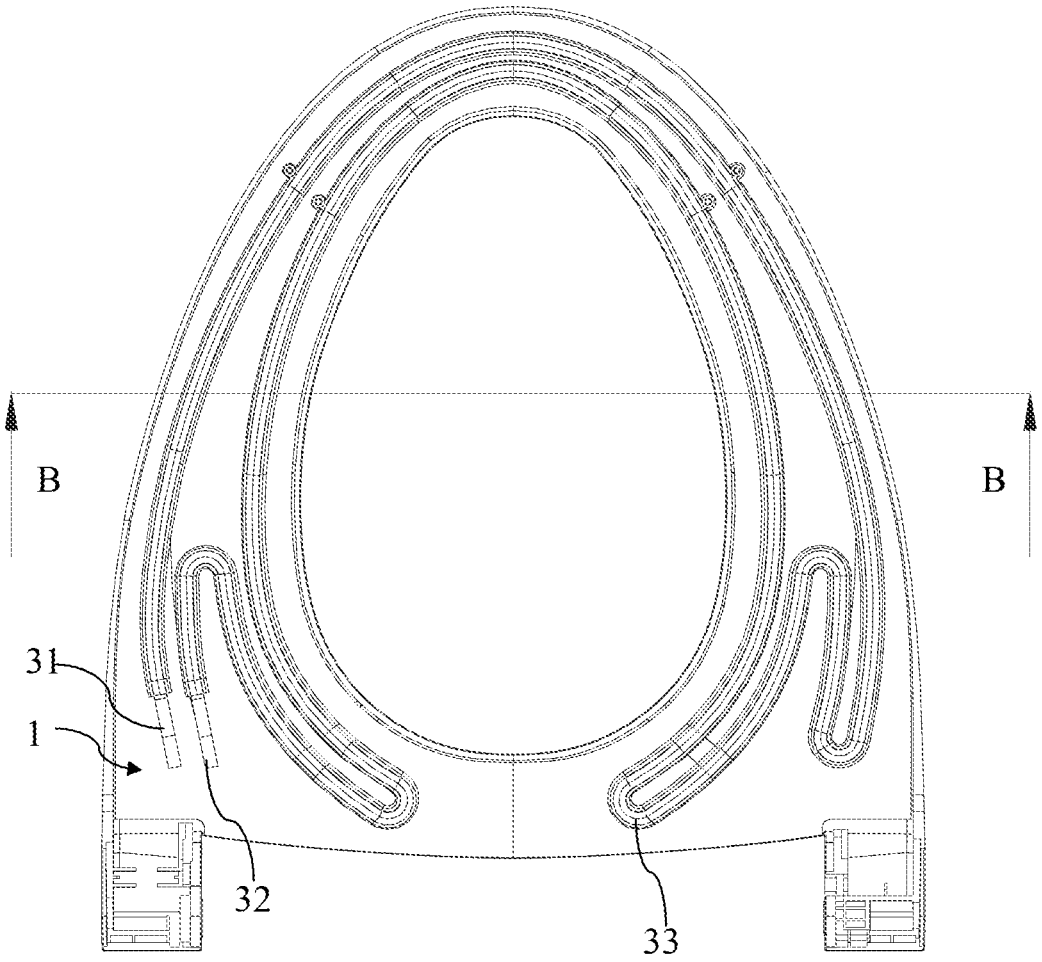
FIG. 7 is a bottom view showing the thermally conductive water pipe body, according to an exemplary embodiment.
Figure 8:
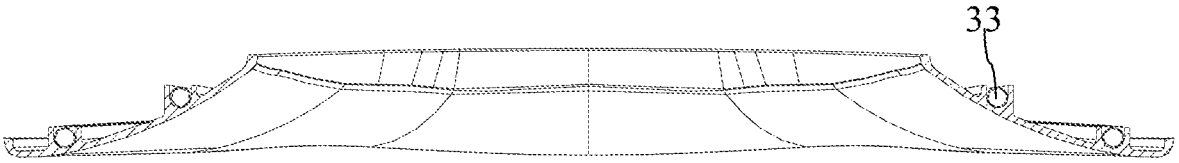
FIG. 8 is a cross-sectional view of the seat taken along line B-B in FIG. 7.

Alternately, the water pipe body 33 can be formed separately from the metal seat 1, then coupled thereto. Referring now to FIGS. 6-8, a slot 13 can be formed on the bottom surface of the metal seat 1 and the thermally conductive water pipe body 33 can be inserted into the slot 13, such as through an interference fit. In other words, the slot 13 may be formed on the bottom surface of the metal seat 1, and during assembly, the thermally conductive water pipe body 33 may be placed inside the slot 13 through interference fit, or directly pressed into the slot 13 through interference. In doing so, a stable connection may be achieved between the thermally conductive water pipe body 33 and the metal seat 1, while facilitating assembly.

Further, as shown in FIGS. 6-8, the overall shape of the slot 13 matches the overall shape of the thermally conductive water pipe body 33, and the whole thermally conductive water pipe body 33 is received inside the slot 13 through the interference fit. In other words, the whole thermally conductive water pipe body 33 is held or clamped tight by the slot 13, thereby improving the stability of the connection.

Another way to form the slot 13 is to directly cut the slot 13 out (e.g., machine) from the bottom surface of the metal seat 1. A slot 13 that is directly cut out from the bottom surface of the metal seat 1 has a relatively high structural strength.

Figure 9:
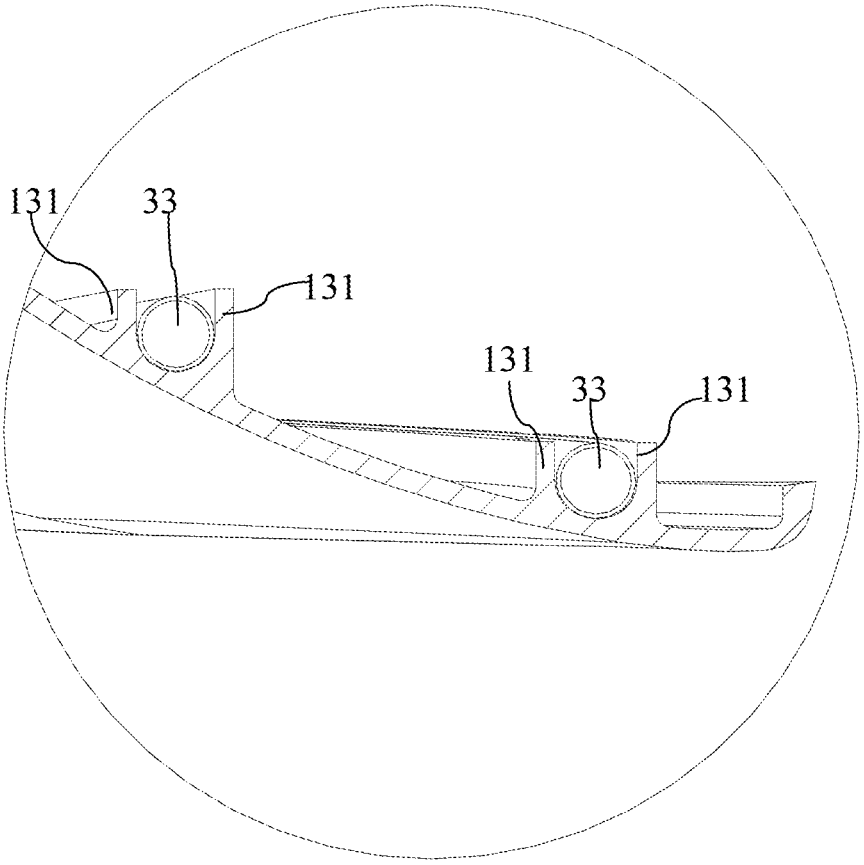
FIG. 9 is an enlarged detail view of a portion of the seat shown in FIG. 8.

As shown in FIG. 9, the slot 13 can be disposed between two ribs 131 arranged to oppose each other, with each rib 131 extending from the bottom surface of the seat. The ribs 131 can be integrally formed (e.g., molded) with the bottom surface of the metal seat 1. For example, a mold may be used for integral molding, which facilitates processing.

In addition, as shown in FIGS. 2-3 and FIG. 7, the water inlet 31 and the water outlet 32 are arranged next (e.g., adjacent) to each other in close proximity. This arrangement advantageously simplifies assembly by facilitating connection with external pipes (that couple to the water inlet and the water outlet) and saves space.

In summary, the heated seat according to the present application uses hot water for heating, which improves the safety and enables the heat from the hot water to be rapidly conducted, thereby improving the comfort in use. The above technical solutions may be combined as needed to achieve the optimal technical effect. Only exemplary embodiments of the present application are described above. It should be noted that, to those skilled in the art, a number of other variations may be further made on the basis of the principle of the present application, all of which shall be encompassed by the scope of the present application.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements can be reversed or otherwise varied and the nature or number of discrete elements or positions can be altered or varied. Accordingly, all such modifications are intended to be included within the scope of the present disclosure. The order or sequence of any process or method steps can be varied or re-sequenced according to alternative embodiments. Other substitutions, modifications, changes, and omissions can be made in the design, operating conditions and arrangement of the exemplary embodiments without departing from the scope of the present disclosure.

Although the figures show a specific order of method steps, the order of the steps may differ from what is depicted. Also two or more steps can be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A heated toilet seat comprising:

a thermally conductive metal seat having an inner edge and an outer edge;

a protective coating disposed on a top surface of the thermally conductive metal seat; and a thermally conductive water pipe in the thermally conductive metal seat, wherein the thermally conductive water pipe comprises a water inlet, a water outlet, and a thermally conductive water pipe body, wherein the water inlet and water outlet are interconnected by the thermally conductive water pipe body, wherein the thermally conductive water pipe comprises a plurality of bending parts and an extension therebetween, wherein an outer path of the extension is adjacent to and follows the same contour as a contour of the outer edge of the metal seat, and an inner path of the extension is adjacent to and follows the same contour as a contour of the inner edge of the metal seat, and the outer path and inner path are connected by the plurality of bending parts, wherein the water inlet and the water outlet are arranged adjacent to each other, and the plurality of bending parts comprises:

a first set of bends connecting the outer path of the extension to the inner path of the extension, the first set of bends comprising first, second, and third bends, the first bend interconnecting the second bend and the outer path of the extension, and the third bend interconnecting the second bend and the inner path of the extension; and a second set of bends connecting the inner path of the extension to the water outlet, the second set of bends comprising fourth and fifth bends, the fourth bend interconnecting the inner path of the extension to the fifth bend, and the fifth bend being connected to the water outlet.

2. The heated seat of claim 1, wherein the thermally conductive water pipe body is integrally formed within the thermally conductive metal seat.

3. The heated seat of claim 1, wherein a slot is formed on a bottom surface of the thermally conductive metal seat and the thermally conductive water pipe body is received inside the slot through an interference fit.

4. The heated seat of claim 3, wherein an overall contour of the slot on the bottom surface of the thermally conductive metal seat matches an overall contour of the thermally conductive water pipe body, and the entire thermally conductive water pipe body is received inside the slot through the interference fit.

5. The heated seat of claim 4, wherein the slot is integrally formed within the bottom surface of the thermally conductive metal seat.

6. The heated seat of claim 5, wherein the slot is defined by two ribs arranged opposing one another, and wherein the ribs are integrally formed on the bottom surface of the thermally conductive metal seat.

7. The heated seat of claim 1, wherein the thermally conductive metal seat comprises a seat installation end and a seat body configured for a user to sit on, wherein the seat installation end connects to a toilet body, and the seat body contains the thermally conductive water pipe body.

8. The heated seat of claim 1, wherein the seat includes a bottom surface, which is offset from the top surface, and a pair of ribs extending from the bottom surface; the ribs are offset from one another and receive the water pipe therebetween; and the thermally conductive water pipe includes copper.

9. The heated seat of claim 1, wherein the protective coating is a corrosion-resistant coating disposed on the top surface of the metal seat.

10. The heated toilet seat of claim 1, wherein the protective coating is thermally conductive.

* * * * *